United States Patent [19]

Platter

[11] Patent Number: 4,552,226

[45] Date of Patent: Nov. 12, 1985

[54] HYDRAULICALLY CONTROLLED BULLDOZER-BLADE

[75] Inventor: Helmuth Platter, Vipiteno, Italy

[73] Assignee: Leitner S.p.A., Vipiteno, Italy

[21] Appl. No.: 594,918

[22] Filed: Mar. 29, 1984

[30] Foreign Application Priority Data

Apr. 1, 1983 [IT] Italy ..... 20448 A/83

[51] Int. Cl.[4] ..... E02F 3/76

[52] U.S. Cl. ..... 172/815; 37/279

[58] Field of Search ..... 172/815, 819, 820, 821; 37/42 R, 42 VL, 44, 41

[56] References Cited

U.S. PATENT DOCUMENTS

| | | | |
|---|---|---|---|
| 3,061,955 | 11/1962 | Violette | 172/815 |
| 3,157,099 | 11/1964 | Ulrich | 172/815 |
| 3,424,251 | 1/1969 | Bouley | 172/815 |
| 3,823,783 | 7/1974 | Luedtke | 172/815 |
| 4,019,268 | 4/1977 | Waterman | 172/815 |
| 4,079,791 | 3/1978 | Yoder | 172/815 |
| 4,099,578 | 7/1978 | Stevens | 172/815 |
| 4,135,583 | 1/1979 | Becker | 172/815 |
| 4,223,461 | 9/1980 | Tackitt | 172/815 |

*Primary Examiner*—Richard J. Johnson

*Attorney, Agent, or Firm*—Oblon, Fisher, Spivak, McClelland & Maier

[57] ABSTRACT

A hydraulically controlled bulldozer-blade attachment, particularly for application to an endless track tractor, exhibits, with a view to an improved versatility of use and a better adaptability to the various ground outlines, two half-blades which are linked to a liftable and depressable intermediate frame, the linking axes of the half-blades being at a backward incline relative to the vertical line with reference to the advance direction and each half-blade being controllable by a double-acting jack of its own. At their ends, the half-blades have sloping extensions which can be oriented about horizontal axes arranged in the direction of advance as controlled by double-acting jacks.

2 Claims, 10 Drawing Figures

HYDRAULICALLY CONTROLLED BULLDOZER-BLADE

BACKGROUND OF THE INVENTION

This invention relates to a hydraulically controlled bulldozer-blade attachment, particularly for application to an endless track tractor. This bulldozer-blade attachment can also fulfil the tasks of grading and shaping of soil or of snow-ploughing.

Bulldozer-blade attachments are known, which comprise a sturdy blade carried by the front section of a tractor, and said blade, in addition to being both liftable and depressable relative to the resting plane of the tractor on the soil, can be position-adjusted on three different planes. A kind of bulldozer-blade attachment of the kind referred to above is shown, for example, in the U.S. Pat. No. 3,882,751.

Such a type of bulldozer-blade attachment provides a supporting frame which can be secured to the tractor, a blade-carrier frame and three intermediate frames which linkably connect the blade-carrier frame to the supporting frame. More particularly, a first intermediate frame is linked to the supporting frame, relatively to which it can swing about a horizontal axis which is transverse to the direction of advance of the tractor, a second intermediate frame is linkably connected to the first intermediate frame with an axis of oscillation which is both vertical and central, whereas a third intermediate frame is linkably connected to the second intermediate frame with an axis of oscillation which is horizontal and is transverse to the direction of advance of the tractor, and the blade-carrier frame is linkably connected to the third intermediate frame with a horizontal central axis of oscillation arranged in the direction of advance of the tractor. The blade-carrier frame and each of the intermediate frames are connected via double-acting hydraulic jacks to the supporting frame and to a preceding intermediate frame, respectively.

SUMMARY OF THE INVENTION

An Object of the present invention is to provide a bulldozer-blade attachment which affords, as compared with the conventional ones, an improved versatility in use and a closer adaption to the outline of the soil to be treated. To achieve this object, the present invention provides a bulldozer-blade attachment comprising a supporting frame to be secured to the tractor, at least an intermediate frame linked to the supporting frame and oscillable relative to it about a horizontal axis which is transverse to the direction of advance of the tractor by the control of a first hydraulic jack of the double-acting type which is operative between the supporting frame and said intermediate frame, and a blade linked to said intermediate frame and oscillable relative thereto about a substantially vertical and central axis on command of at least a second double-acting hydraulic jack which is active between the intermediate frame and the blade. The blade is subdivided into two discrete half-blades linkably connected to said intermediate frame and swingable relative thereto about at least one substantially central axis which is preferably sloping backwards with respect to the vertical line with reference to the direction of advance of the tractor. For the oscillation of each half-blade there is provided a discrete double-acting hydraulic jack acting between the intermediate frame and the attendant half-blade.

The axes of oscillation of the two half-blades relative to the intermediate frame may even coincide, but in an advantageous embodiment each half blade may have an oscillation axis of its own: if so, the two axis are appropriately brought close to one another.

It is also appropriate to provide the possibility of varying the slope relative to the vertical of the axis or axes of oscillation of the half-blades and, in such a case, there can be inserted between the intermediate frame and each half-blade, an additional intermediate frame carrying the axle of oscillation of the relevant half-blade and oscillable, in its turn, relative to the first intermediate frame, about a horizontal axis which is transverse relative to the direction of advance of the tractor upon a command from a double-acting hydraulic jack which is active between said first and said additional intermediate frames.

According to a preferred embodiment of the bulldozer-blade attachment according to the invention, each of its half-blades can have an orientable extension which forms an obtuse angle with the relative half-blade and is oscillable about a horizontal axis arranged in the direction of advance of the tractor upon command from a double-acting hydraulic jack which is active between the half-blade and a projection of the relevant extension.

BRIEF DESCRIPTION OF THE DRAWINGS

The features of the bulldozer-blade attachment according to the invention and the advantages afforded thereby will become more clearly apparent from the ensuing description which is given in detail with reference to the accompanying drawings which diagrammatically show a few embodiments, namely:

FIG. 2A is a plan view of a variant of the attachment shown in FIG. 1;

DETAILED DESCRIPTION OF THE PREFERRED EMBODIMENTS

Figure 1:
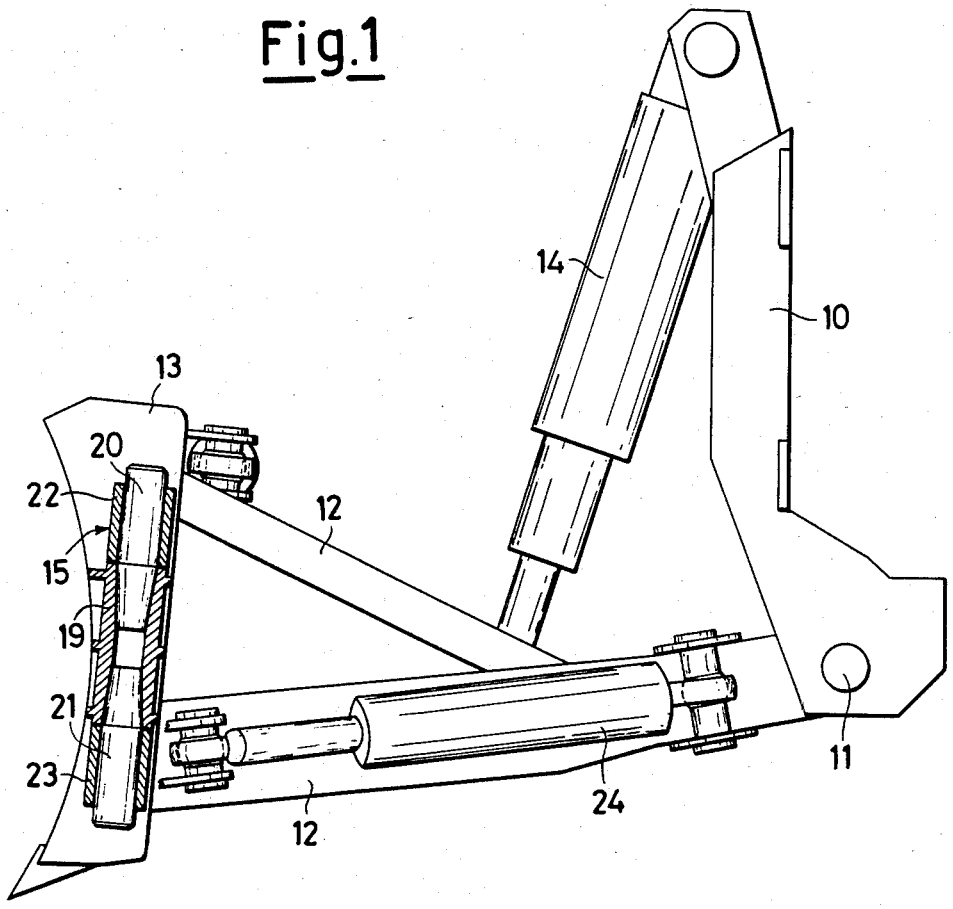
FIG. 1 is a first embodiment of the attachment in side elevational view, partially in cross-section.
Figure 3:
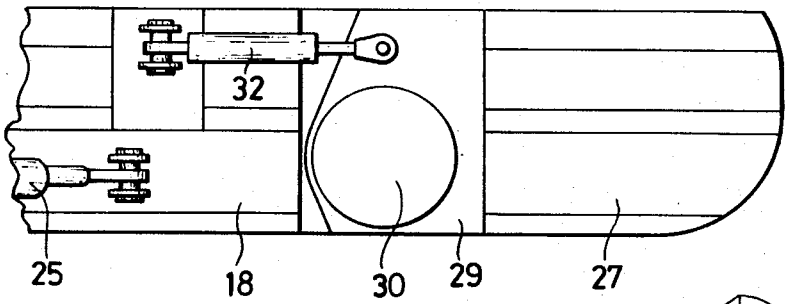
FIG. 3 is a detail view of the attachment as viewed along the direction of the arrow III of FIG. 2.
Figure 2:
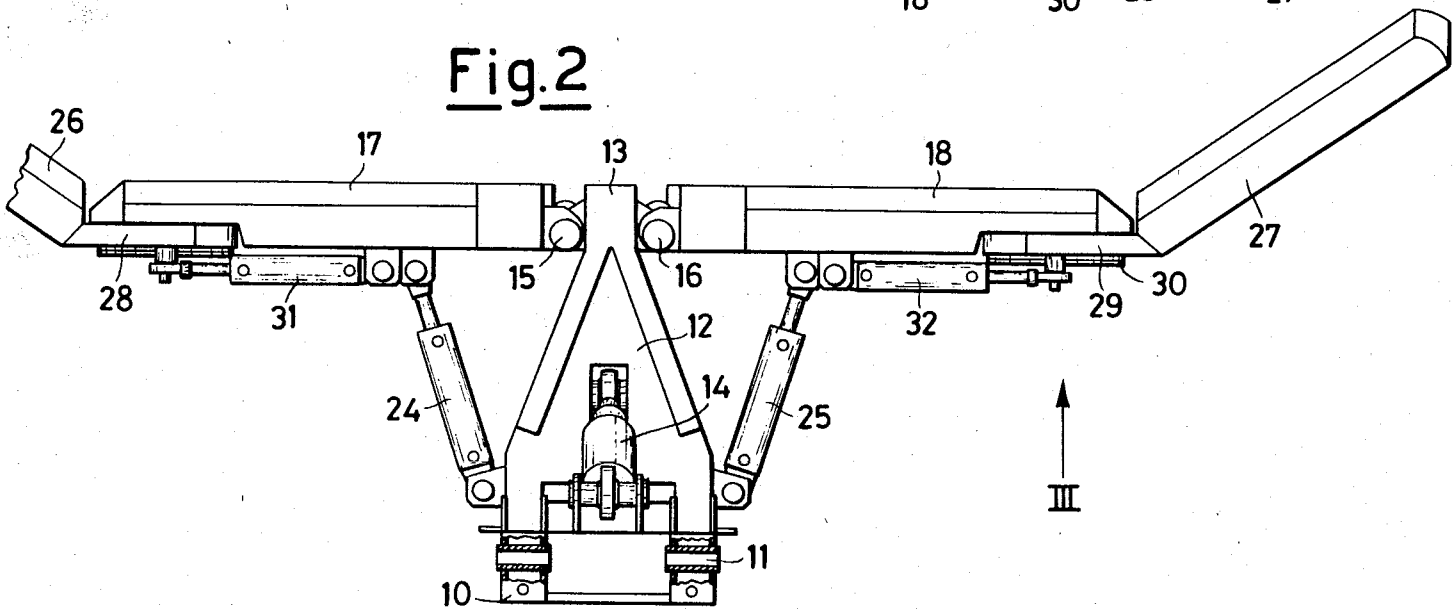
FIG. 2 is a plan view of the attachment shown in FIG. 1.

The bulldozer-blade attachment as shown in FIGS. 1 to 3 comprises a supporting frame 10, which can be secured to the front section of a vehicle, such as a caterpillar tractor (not shown).

To this supporting frame 10 there is linkably connected, through an oscillation axle 11 which is horizontal and transverse relative to the direction of advance of the tractor, an intermediate frame 12, which, as viewed in plan view, has a substantially triangular outline with its apex pointing forwards. This intermediate frame 12, has, integral therewith, a substantially vertical front section 13.

Between the supporting frame 10 and the intermediate frame 12 a double-acting hydraulic jack 14 is active, for example one of the telescopable type, which, on the one side, is linked upwards to the supporting frame 10 and, on the other side, is linkably connected to a central point of the substantially triangular intermediate frame 12.

The substantially vertical central front portion 13 of the intermediate frame 12 carries, on the two sides thereof the pivotal axles 15 and 16, respectively, for two half-blades 17 and 18 which are extended on the two sides of the central front section 13 of the intermediate frame 12. It should be noted that, when the bottom scraping edges of the two half-blades 17,18 contact the ground, the linking axles 15,16 are preferably slightly sloping rearwards relative to the vertical line, relative to the direction of advance of the tractor, as clearly shown in FIG. 1.

Each of said linking axles can consist of a central bush 19 secured to the side of the central section 13 of the intermediate frame 12, said bush having a biconical through-bore to receive two pins 20,21 which are inserted, with their conical ends from the two ends of the bush 19, whereas their portion which emerges from the bush is cylindrical. On these cylindrical portions of the pins 20,21, there are mounted bushings 22,23, having a cylindrical bore, which are integral with the half-blade concerned. Between each half-blade 17 and 18 and the intermediate frame 12, a discrete double-acting hydraulic jack 24 and 25, respectively, is operative and is capable of having the half-blade concerned swinging about its own pivotal axle 15 and 16, respectively, in the central section 13 of the intermediate frame 12. The jacks 24,25 are linkably connected to the intermediate frame 12 and to the half-blades 17,18, respectively, by spherical joints. Each half-blade 17 and 18 carries at its free end an extension 26 and 27, respectively, which forms with the half-blade concerned an obtuse angle. To each extension 26,27, there is integrally secured a planar projection 28, and 29, respectively, which can seat in a rear recess of the relevant half-blade, said projection being linkably connected to the blade by a pin such as pin 30 shown in FIG. 3. The axes of said pivotal pins of the extension to the respective half-blades are horizontal and are arranged in the direction of advance of the tractor when the half-blades are oriented perpendicularly to the direction of advance aforementioned (as shown in FIG. 2). Between each half-blade 17, 18 and the projection 28,29 of the relative extension 26,27, a double-acting hydraulic jack 31,32 is operative, and is secured to the relative projection eccentrically relative to the linking pin, as can be seen in FIG. 3, so as to be able to rotate the projection with the extension about the axis of the pin in the direction shown by the double arrow indicated in FIG. 3.

It should be noted that, in the embodiment just now described, the two half-blades 17,18 are oscillable relative to the intermediate frame 12 about fixed axles 15 and 16, respectively, which, as outlined above, are preferably slightly at an incline relative to the vertical line and backwards as referred to the direction of advance of the bulldozer-blade attachment.

Instead of providing two discrete linking axes for the two half-blades, these two axes could even coincide, and, if so, the two half-blades would swing about the same central axis 15A (FIG. 2A).

Figure 9:
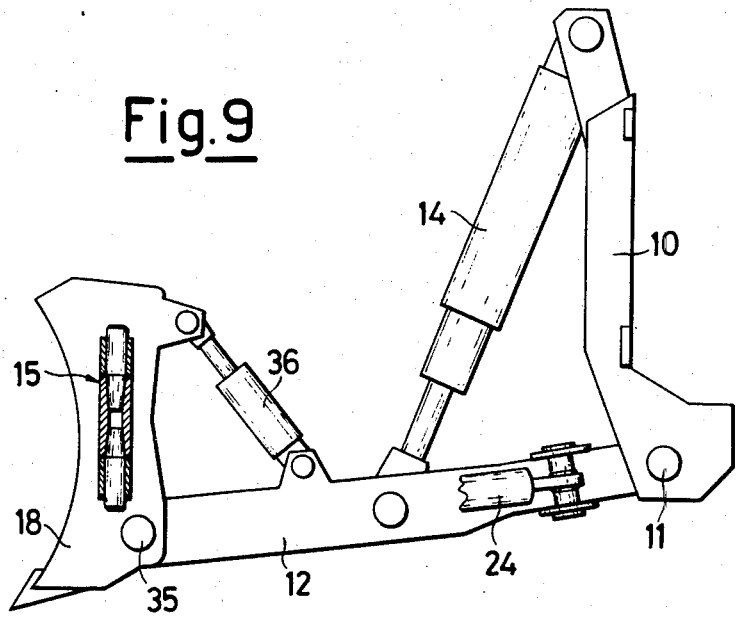
FIG. 9 is a side view of a modified version of the attachment.
Figure 10:
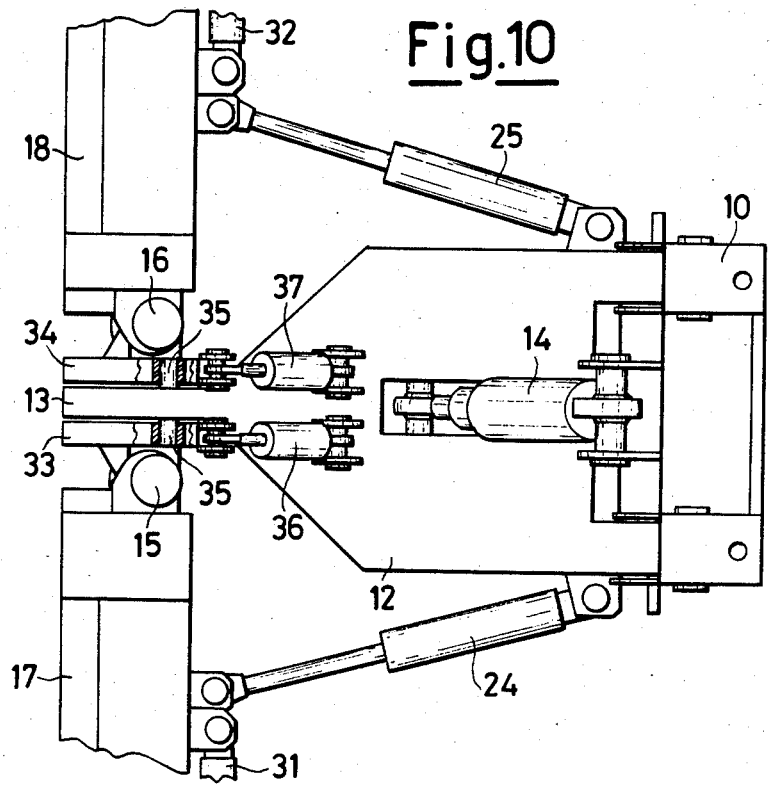
FIG. 10 is a plan view of the attachment shown in FIG. 9.

Should one desire to vary the incline of the axes of oscillation 15,16, relative to the vertical line, it is possible to insert between the intermediate frame 12, and more exactly its vertical front section 13, and each half-blade 17,18 an additional intermediate frame. Such a possibility is shown in the embodiment illustrated in FIGS. 9 and 10, wherein the portions of the attachment which have already been depicted in FIGS. 1 to 3 bear the same reference numerals.

As can be seen, on the two sides of the front central section 13 of the intermediate frame 12 are mounted two additional intermediate frames 33 and 34, respectively, which are linked, at their lower portion, to the section 13 by linking axles 35, horizontal and transverse to the direction of advance of the attachment. Between the top section of each of said additional intermediate frames 33,34 and the intermediate frame 12 are active double-acting hydraulic jacks 36 and 37, respectively, whereby each of the frames 33,34 can be rotated, independently of one another, about the common oscillation axle 35. Inasmuch as the frames 33,34 carry the linking axles 15 and 16, respectively, of the half-blades 17,18 the rotation of the frames 33,34 about the axles 35 can modify the incline relative to the vertical line of the axles 15 and 16.

As outlined above, the connection of the jacks 24,25 to the intermediate frame 12 and to the half-blades 17,18, is embodied by spherical joints of known make. If so desired for constructional reasons, it is possible to provide spherical connection joints also for the other double-acting hydraulic jacks contemplated for the attachment according to the invention.

The attachment according to the invention, which lends itself quite especially for the preparation, grading and shaping of skiing tracks, possesses quite a particular versatility and possibility of adaption to the outline of the soil. This result is mainly achieved due to the splitting of the material treating blade and also to the fact that each half-blade has an adjustable sloping extension.

FIGS. from 4 to 8 inclusive diagrammatically show a few possibilities of use of the attachment according to the invention, as having been made possible by the provision of the two discrete half-blades and their attendant orientable extensions.

Figure 4:
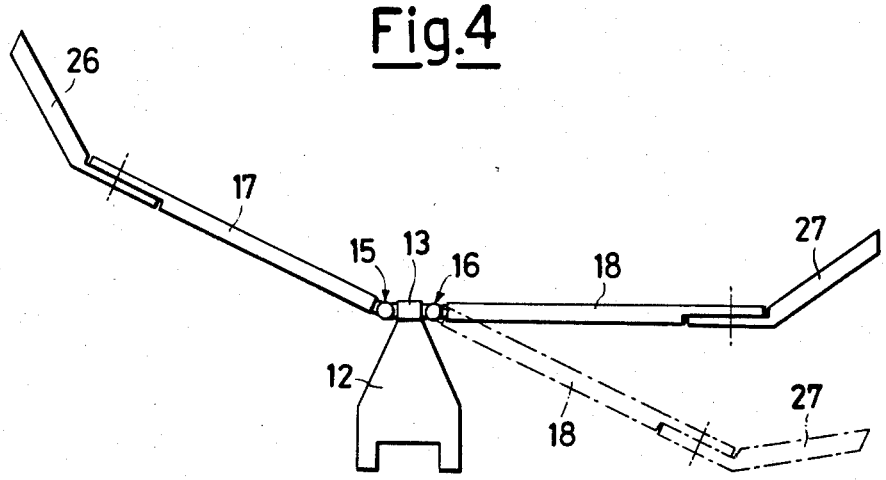
FIGS. 4 and 5 diagrammatically show in plan view two different ways of operation of the attachment.

In FIG. 4 it has been shown how the left-hand half-blade 17 (as viewed in the direction of advance) is placed obliquely forward relative to the plane which is perpendicular to the direction of advance, whereas the right-hand half-blade 18 is positioned perpendicularly to the direction of advance (position as indicated in solid lines), or is placed obliquely rearwards (position indicated in dotted lines). By so doing, the material, for example snow, as collected along the left edge of the track by the left half-blade, glides over the oblique surface of the latter half-blade to the centre and is pushed forward by the right half-blade (if the latter is in the position shown in solid lines), or the snow is discharged towards the right edge of the track (if the right half-blade is positioned in the position shown in dotted lines).

Figure 5:
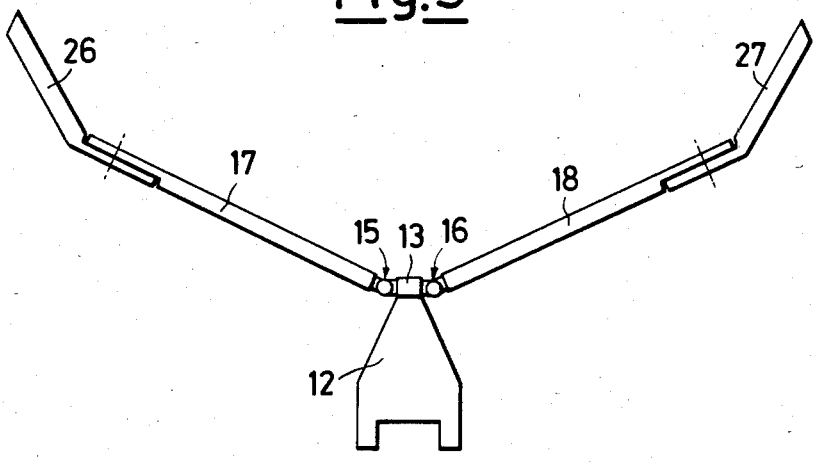

If both the half-blade 17 and 18 are positioned obliquely forward, as shown in FIG. 5, it is possible to feed foward a larger mass of material along a longer path.

Figure 6:
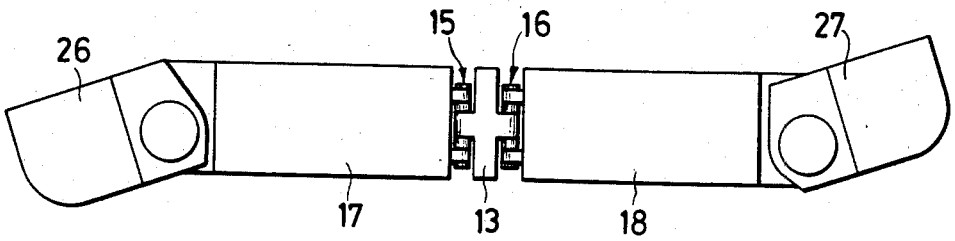
FIGS. 6, 7 and 8 diagrammatically show in rear views other modes of operation of the device.

The orientation of the extensions 26,27 of the two half-blades 17,18, for example as shown in FIG. 6, makes it possible to match in a closer way and irregular ground profile.

The incline relative to the vertical of the oscillation axles 15,16 of the two half-blades 17,18 serves also to improve the adaptability to the outline of the soil.

Figure 7:
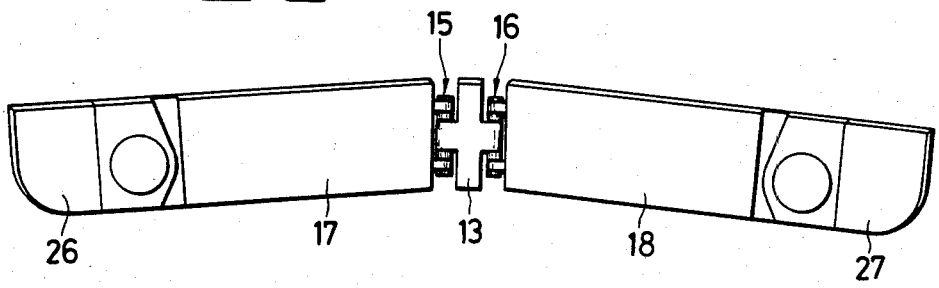
Figure 8:
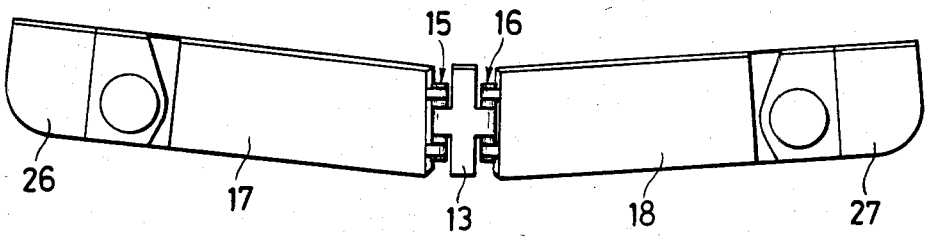

If the two half-blades 17,18 are shifted rearwards (see FIG. 7), due to the incline of their oscillation axes, the half-blades adapt themselves to a convex track outline, whereas, with a forward displacement (FIG. 8) one obtains the adaption to a concave track outline.

The orientation of the two extensions 26,27 of the half-blades 17,18 can also be automatically synchronized with the lifting and the depression of the intermediate frame 12 which carries the two half-blades, in the sense of properly lowering the extensions when the intermediate frame is lifted, or vice versa, so as to obtain that in the neutral position the two extensions and the two half-blades delineate a straight line. This synchronized automatic control can be obtained easily by appropriate hydraulic connections of the operative jacks 14,31 and 32. Let it be understood that the drawings show only a few typical cases of use of the attachment according to the invention, and these cases cannot be obtained with the conventional single-blade attachments, or possibly, with U-blades or with extensions orientable about vertical axes.

These cases, however, are not limitations and the invention is not even restricted to the exemplary embodiments described and shown herein.

I claim:

1. A hydraulically controlled bulldozer-blade attachment for an endless track tractor, comprising:

a supporting frame securable to a tractor;

a first intermediate frame pivotally connected to said supporting frame about a first horizontal axis extending transverse to a direction of advance of said tractor;

a first double acting hydraulic jack connected between said supporting frame and said first intermediate frame for controlling an inclination of said first intermediate frame about said first axis; two second intermediate frames, each said second intermediate frame being pivotally connected to said first intermediate frame about a respective second horizontal axis extending transverse to a direction of advance of said tractor;

a second double acting hydraulic jack connected between said first intermediate frame and each said second intermediate frame for independently controlling inclinations of said second intermediate frames about said second axes;

a half blade pivotally connected to each said second intermediate frame about a respective third axis, each said third axis extending parallel to a first vertical plane extending in said direction of advance of said tractor, each said third axis being adjustable relative to a second vertical plane extending transverse to said direction of advance by one of said second jacks, said second jacks being adapted such that said third axes are rearwardly inclined to said second vertical plane; and a third double acting hydraulic jack connected between said second intermediate frame and each of said half blades for controlling inclinations of said half blades about said third axes.

2. The attachment of claim 1 including: an extension pivotally connected about a fourth axis to each said half blade at an end of said half blade opposite said third axis, each said fourth axis comprising a horizontal axis extending transverse to the length of said half blade, each said extension having a length extending at an obtuse angle relative to a respective half blade to which said extension is pivotally connected; and a fourth double acting hydraulic jack connected between each said blade and a respective extension for controlling inclinations of said extensions about said fourth axes.

* * * * *